United States Patent [19]

DeHaitre

[11] Patent Number: 5,029,405

[45] Date of Patent: Jul. 9, 1991

[54] CLEAT FOR BOOT SOLE AND THE LIKE

[75] Inventor: Lon DeHaitre, Arlington Heights, Ill.

[73] Assignee: Abbott-Interfast Corporation, Wheeling, Ill.

[21] Appl. No.: 360,264

[22] Filed: Jun. 2, 1989

[51] Int. Cl.[5] ..... A43B 5/00

[52] U.S. Cl. ..... 36/134; 36/67 D; 36/67 R

[58] Field of Search ..... 36/67 R, 67 A, 67 B, 36/67 C, 67 D, 126, 127, 128, 129, 134

[56] References Cited

U.S. PATENT DOCUMENTS

| | | | |
|---|---|---|---|
| 167,239 | 8/1875 | Guilford | 36/67 B |
| 1,012,057 | 12/1911 | Brody | 36/134 X |
| 1,687,634 | 10/1928 | Pierce | 36/67 D |
| 1,954,761 | 4/1934 | Wiggin | 36/67 D |
| 2,118,113 | 5/1938 | Schemel | 36/134 X |
| 2,163,089 | 6/1939 | Hagerty | 36/134 X |
| 2,258,805 | 10/1941 | Phillips | 36/67 D |
| 2,342,777 | 2/1944 | Wisckol | 36/134 X |
| 2,484,389 | 10/1949 | Schatz | 36/116 X |
| 2,564,802 | 8/1951 | Coleman et al. | 36/676 |
| 2,626,454 | 1/1953 | Richardson | 36/134 X |
| 2,918,733 | 12/1959 | Anderson | 36/134 |
| 3,029,529 | 4/1962 | Schwartz | 36/126 |
| 3,236,555 | 2/1966 | Shrier | 36/67 A |
| 3,403,461 | 10/1968 | McCarney | 36/134 X |
| 3,672,077 | 6/1972 | Coles | 36/134 |
| 3,707,047 | 12/1972 | Nedwick | 36/134 |
| 3,793,751 | 2/1974 | Gordos | 36/134 X |
| 4,035,934 | 7/1977 | Hrivnak | 36/134 X |
| 4,271,608 | 6/1981 | Tomuro | 36/134 X |
| 4,292,746 | 10/1981 | Delaney | 36/134 X |
| 4,306,360 | 12/1981 | Hagger | 36/134 X |
| 4,318,231 | 3/1982 | Simoneau | 36/134 X |
| 4,328,627 | 5/1982 | Sanders | 36/134 X |
| 4,333,249 | 6/1982 | Schaefer | 36/134 X |
| 4,366,632 | 1/1983 | Bente | 36/134 X |
| 4,375,729 | 3/1983 | Buchanen | 36/134 X |
| 4,447,969 | 5/1984 | Johnson | 36/116 |
| 4,466,205 | 8/1984 | Corbari | 36/134 |
| 4,561,197 | 12/1985 | Misevich | 36/134 X |
| 4,633,600 | 1/1987 | Dassler | 36/134 |
| 4,635,383 | 1/1987 | Free | 36/134 X |
| 4,677,765 | 7/1987 | Lubet et al. | 36/116 X |

FOREIGN PATENT DOCUMENTS

| | | | |
|---|---|---|---|
| 748607 | 12/1966 | Canada . | |
| 873080 | 6/1971 | Canada . | |
| 955398 | 10/1974 | Canada . | |
| 1115951 | 1/1982 | Canada . | |
| 1197679 | 12/1985 | Canada . | |
| 1227332 | 9/1987 | Canada . | |
| 732328 | 6/1955 | United Kingdom | 36/67 D |
| 1139239 | 1/1969 | United Kingdom | 36/67 A |

OTHER PUBLICATIONS

Selected Pages of Publication of West Coast Shoe Company, Scappoose, Oregon, Entitled "Real Boots. . . . Hand-Make in America by Craftsmen".

Selected Pages of Publication of Hathorn Mfg. Entitled "Hathorn Boots-Hand-Forged Quality".

Selected Pages of Catalog Entitled "White's Handmade Boots" Two Page Brochure of White's Handmade Boots, Spokane, WA.

*Primary Examiner*—David T. Fidei
*Assistant Examiner*—Ted Kavanaugh
*Attorney, Agent, or Firm*—Welsh & Katz, Ltd.

[57] ABSTRACT

A cleat or calk for use with boot soles and the like to provide enhanced gripping and wear life includes a generally cup-shaped spike member defining a plurality of pointed spike elements spaced about and projecting from a base adapted for mounting on a boot sole through a mounting shank and sole-mounted cleat anchor. In one embodiment, spring means cooperates with the spike member and mounting shank to enable limited pivotal movement of the spike member when mounted on a boot sole so as to acommodate uneven surfaces engaged by the spike member, while effecting self-leveling of the spike member upon release from the underlying surface.

28 Claims, 2 Drawing Sheets

CLEAT FOR BOOT SOLE AND THE LIKE

BACKGROUND OF THE INVENTION

The present invention relates generally to cleats or calks for use on the soles of boots and the like, and more particularly to a novel cleat or calk which provides improved gripping and longer life over prior cleats and calks.

It is a common practice to enhance the ground gripping characteristics of numerous types of footwear through the mounting of cleats, spikes or calks on their soles. The ground gripping characteristics of certain sporting event shoes, such as golf shoes, are conventionally improved by mounting conical spike-like elements on the soles. The spikes generally have threaded shanks which enable releasable threaded mounting in receptacles or anchor inserts secured to the soles in spaced patterns. Similar type spikes have been employed with mountain climbing boots and boots used by loggers, forestry workers and hunters.

A significant drawback in the use of known spike-type grip enhancing devices on boots and the like, and particularly boots such as loggers boots which undergo rigorous use on various terrains including rocks and logs, is that the spikes undergo relatively rapid wear and lose their gripping characteristics, thus requiring relatively frequent replacement or maintenance. The reduction or loss of gripping ability also greatly diminishes the safety factor expected from use of the spikes. Moreover, in the case of logging boots, a substantial number of the spikes, such as thirty or more, may be mounted on a single sole. The cost of replacement or maintenance of the spikes can therefore be quite significant.

In the case of logging boots, attempts to address the aforedescribed problems encountered with spike-type cleats or calks have included the mounting of tricounies along the edge of a sole which also has conical spike-type calks mounted thereon. The tricounies have toothed or serrated edges which dig into the wood or bark of a tree and further enhance gripping with attendant improved safety. Again, however, the use of tricounies leads to increased cost without significantly increasing the wear life of the associated spike-type calks. Accordingly, a cleat or calk having improved gripping and wear life characteristics would result in greater safety and economic efficiencies than experienced with known cleats and calks.

SUMMARY OF THE INVENTION

One of the primary objects of the present invention is to provide an improved cleat or calk for use with boot soles and the like and which results in enhanced gripping and wear life characteristics over prior cleats or calks.

A more particular object of the present invention is to provide an improved cleat or calk which finds particular application with boots and the like such as worn by loggers, forestry workers and hunters and the like, and which provides improved safety on substantially all terrain surfaces at relatively modest cost.

Still another object of the present invention is to provide a novel cleat or calk which, in various of its embodiments, is relatively inexpensive to manufacture and exhibits improved gripping over prior cleats or calks.

A further object of the invention is to provide a novel cleat or calk having a generally cup-shaped spike member defining a plurality of pointed spike elements spaced about and projecting from a base, and wherein, in one embodiment, the spike member is adapted for mounting on a boot sole or the like so as to undergo limited pivoting to accommodate an uneven surface being traversed, and which effects self-leveling upon release from the underlying surface.

A feature of the self-leveling embodiments of the cleat or calk in accordance with the invention lies in the provision of a spring member which may be disposed between the spike member and a sole upon which the cleat is mounted, or between the spike member and the head of a mounting screw securing the spike member to a boot sole such that the spring member accommodates pivoting of the spike member and effect self-leveling after each release from an underlying uneven object or terrain.

Still another feature of the spike or calk in accordance with the invention lies in the provision of a mounting shank which, in various embodiments, cooperates with the spike member so as to facilitate releasable mounting of the calk on a boot sole or the like through a conventional anchor insert affixed to the sole, thus enabling replacement of known conical spike-type calks with improved calks of the present invention.

Further objects, advantages and features of the invention, together with the organization and manner of operation thereof, will become apparent from the following detailed description of the invention when taken in conjunction with the accompanying drawings wherein like reference numerals designate like elements throughout the several views.

DETAILED DESCRIPTION

Figure 1:
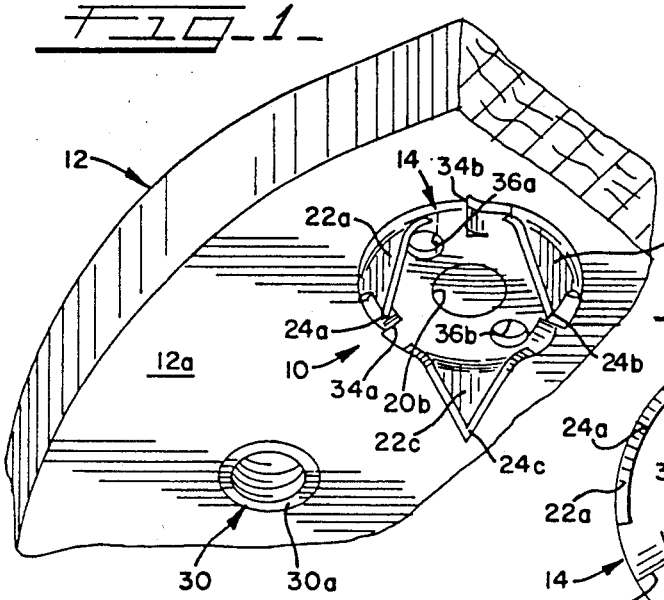
FIG. 1 is a fragmentary perspective view, on an enlarged scale, of a boot sole having a cleat or calk constructed in accordance with one embodiment of the present invention mounted on the sole.
Figure 3:
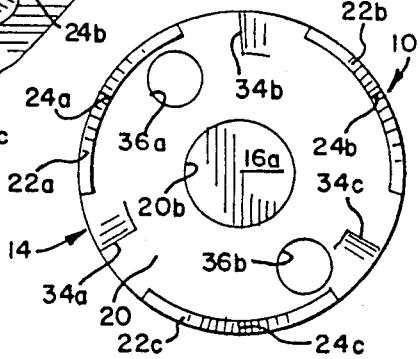
FIG. 3 is a bottom view of the cleat of FIG. 2.
Figure 2:
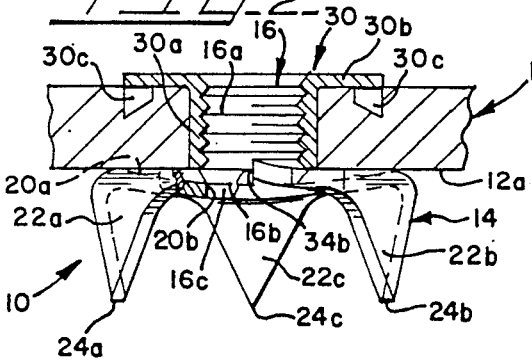
FIG. 2 is a fragmentary side elevational view, on an enlarged scale and taken partly in vertical section, of the cleat and sole shown in FIG. 1.

Referring now to the drawings, and in particular to FIGS. 1–3, a cleat or calk in accordance with one embodiment of the present invention is indicated generally at 10. The cleat or calk 10 is adapted for mounting on the soles of various types of footwear such as boots and the like as used by loggers, forestry workers, hunters and hikers when traversing terrain where enhanced gripping of the boot to the ground or other object, such as a log, on which the wearer is maneuvering is desirable for safety purposes. As will become apparent, the cleat or calk 10 may also find application on other types of footwear. In the embodiment illustrated in FIGS. 1 and 2, the cleat or calk is shown as being affixed to the lower surface 12*a* of a boot sole, a fragmentary portion of which is indicated at 12, and includes a generally cup-shaped spike member 14 and a mounting shank portion 16.

The cup-shaped spike member 14 may be formed from a suitable metallic material such as steel or stainless steel of an appropriate thickness which lends itself to stamping and drawing operations and which may be suitably hardened and/or passivated. Alternatively, the spike member 14 may be formed from hardened steel, anodized aluminum, suitable plastic or a suitable composite material. The spike member includes a generally circular base 20 which is slightly dish-shaped or undercut so as to present a concave surface 20*a* toward the surface of a sole on which the cleat is to be mounted. A plurality of downwardly extending generally parallel triangular shaped spike elements, indicated at 22*a, b* and *c*, are affixed to the base 20 such that the base edges of the spike elements are equidistantly circumferentially spaced about the circular periphery of the base. The spike elements may be formed integral with the base 20, as by being initially formed generally coplanar with the base 20 and thereafter formed downwardly to depend from the circular base in generally parallel relation to the center axis of the base. The spike elements 22*a–c* are of equal size and define downwardly facing pointed tips 24*a–c*, respectively, which lie in a common plane generally parallel to the base 20 with the pointed tips angularly spaced from each other by approximately 120°. The spike elements are configured to facilitate periodic sharpening of their pointed tips, if desired.

In the embodiment of FIGS. 1–3, the mounting shank portion 16 of cleat 10 is securely affixed to the cup-shaped spike member 14 so as to be substantially integral therewith. To this end, the shank portion 16 includes a generally cylindrical external threaded surface 16*a* which terminates at its inner end in an annular shoulder surface 16*b* formed adjacent a reduced diameter end 16*c* received within a circular central opening 20*b* in the base 20. The cylindrical end 16*c* of the mounting shank is preferably fixed within the circular opening 20*b* in the base 20 by welding, staking, coining or any other suitable technique which secures the shank portion and spike member in fixed coaxial relation. In one embodiment of the cleat 10, the circular base 20 was formed with a diameter of approximately 0.75 inch, and with 25 the spike elements 22*a–c* having longitudinal lengths of approximately 0.30 inch from their pointed tips to a plane containing the peripheral edge of the base surface 20*a*. The shank 16 may be formed to extend approximately 0.20 inch from the plane containing the peripheral edge of the base surface 20.

To facilitate mounting of a plurality of the cleats or calks 10 on the bottom of the sole 12, the sole is provided with a plurality of selectively positioned cleat or calk mounting receptacles or anchors, as indicated at 30 in FIGS. 1 and 2. The mounting anchors 30 may be of conventional design and each includes a cylindrical internally threaded tubular sleeve or barrel portion 30*a* formed integral at one end with a generally annular coaxial flange 30*b*. A plurality of anchor elements 30*c*, such as four, are formed in equal angular spaced relation about the flange so as to extend in generally parallel spaced relation to the sleeve portion 30*a* and lie in radial planes containing the longitudinal axis of the sleeve portion. In preparing the sole 12 for mounting a plurality of cleats or calks 10 thereon, a plurality of cylindrical openings or bores 32 are formed in the sole at predetermined positions to snugly receive the sleeves 30*a* of a corresponding number of cleat mounting anchors 30 which then have their anchor elements pressed into the sole so as to prevent rotation of the mounting anchors. Each of the internally threaded anchor sleeves 30*a* is adapted for threaded engagement with the threaded shank portion 16*a* of a cleat or calk 10 as illustrated in FIG. 2.

Preferably, a plurality of barbs are formed on the spike member 14 so as to embed themselves within the sole 12 during assembly of the cleat into a mounting anchor 30 and prevent inadvertent or unintended counter-rotation of the cleat in a direction to release from the mounting anchor. In the illustrated embodiment, three barbs 34*a–c* are formed in equal angular spaced relation about the circular base 20 intermediate the spike elements 22*a–c* by shearforming segments of the base at the its periphery and displacing the sheared segments from the base so that generally radial barb edges are formed.

To assist in threaded attachment of a cleat or calk 10 to a mounting anchor 30 on the boot sole 12, and enable subsequent removal, a pair of spanner holes 36*a* and 36*b* are formed in the base 20 such that their center axes lie on a common diameter and are spaced apart a distance sufficient to receive a pair of drive studs on a spanner-type wrench. In this manner a plurality of cleats or calks may be readily mounted on a boot sole or the like, and subsequently removed for sharpening or replacement.

Figure 4:
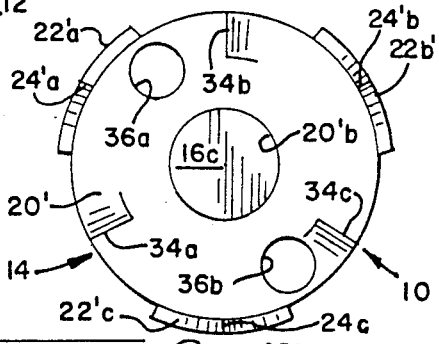
FIG. 4 is a bottom view of an alternative embodiment of a cleat or calk in accordance with the invention.

In the embodiment illustrated in FIGS. 1–3, the triangular spike elements 22*a–c* are formed with arcuate transverse profiles such that their outer peripheral surfaces lie in a cylindrical envelope containing the outer peripheral edge of the base 20 intermediate the spike elements as shown in FIG. 3. FIG. 4 is a bottom view of an alternative cleat or calk, indicated at 10', which is generally similar to the cleat 10 of FIGS. 2 and 3, but includes a spike member 14' having three equal angularly spaced triangular spike elements 22'*a–c* formed normal to the plane of the base 20' so that inner arcuate surfaces of the spike elements lie in a cylindrical envelope containing the outer peripheral edge of the base intermediate the spike elements.

Figure 5:
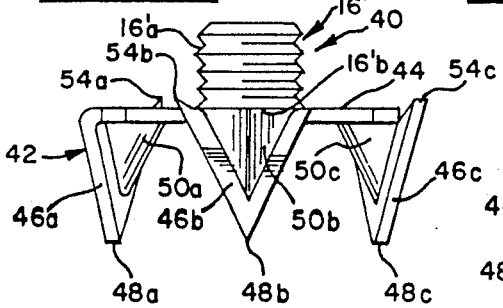
FIG. 5 is a side elevational view of another embodiment of a cleat or calk in accordance with the invention.
Figure 6:
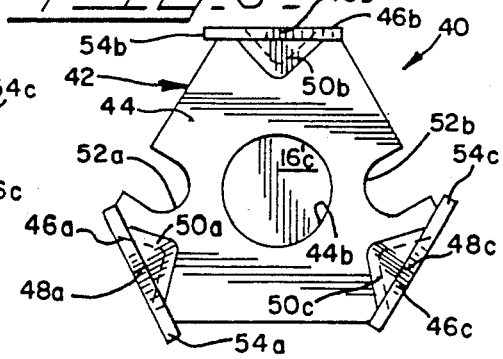
FIG. 6 is a bottom view of the cleat illustrated in FIG. 5.

FIGS. 5 and 6 illustrate another embodiment of a cleat or calk, indicated generally at 40, which includes a spike member 42 to which is affixed a threaded mounting shank 16' to enable mounting of the cleat on a boot sole or the like through threaded connection to a cleat anchor 30. The spike member 42 may be made from a suitable metallic material such as steel or stainless steel similar to the spike member 14, and includes a generally triangular planar base 44 having three downwardly depending spike elements 46*a–c*. The spike elements 46*a–c* may be formed from triangular corner portions of a triangular shaped base 44 such that the spike elements lie normal to the base 44 and define relatively sharp pointed ends 48*a–c* which are equally angularly spaced about the center axis of the triangular base and lie in a common plane parallel to the base. The spike elements 46*a–c* are preferably formed from the base 44 so as to simultaneously form corresponding reinforcing ribs or gussets 50*a–c* interposed between the base and each spike element.

The mounting shank 16' is similar to shank 16 and includes an externally threaded end 16'*a* which terminates at its inner end in a radial shoulder 16'*b* peripherally of a reduced diameter cylindrical end portion 16'*c* snugly received within a circular central opening 44*b* in the base 44. The cylindrical end 16'*c* may be welded, staked, coined or otherwise suitably affixed within the opening 44*b*. Alternatively, the shank 16' and spike member 42 may be formed integral as a unitary metallic calk. To assist in mounting the cleat or calk 40 into a mounting anchor 30 within a boot sole or the like, a pair of generally semi-circular recesses 54*a* and 54*b* are formed in the base 44 spaced apart sufficiently to receive a pair of drive studs on a spanner wrench in similar fashion to the spanner holes 36*a,b* formed in the base 20 of the cleat or calk 10. Each of the triangular spikes 46*a–c* is preferably formed with a barbed spike point 54*a–c*, respectively, which are adapted to dig into the surface of a sole on which the cleat or calk 40 is mounted so as to prevent unintended or inadvertent loosening or release of the cleat from an associated mounting anchor 30 within the boot sole.

Figure 7:
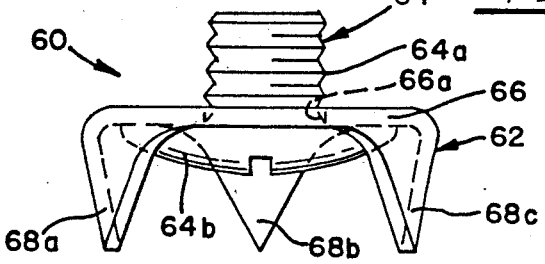
FIG. 7 is a side elevational view of a cleat or calk in accordance with another embodiment of the invention.
Figure 8:
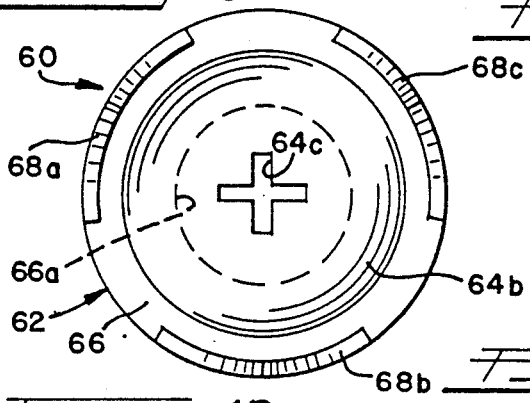
FIG. 8 is a bottom view of the cleat of FIG. 7.

FIGS. 7 and 8 illustrate another embodiment of a cleat or calk, indicated generally at 60, in accordance with the present invention. The cleat or calk 60 includes a generally cup-shaped spike member 62 and a mounting shank 64 which are functionally similar to the aforedescribed spike member 14 and shank portion 16 of cleat 10. The spike member 62 has a generally circular planar base 66 from which is formed three downwardly extending equal angularly spaced triangular-shaped spike elements 68*a–c* similar to the spike elements 22*a–c*. The mounting shank 64 of the cleat or calk 60 is formed as a separate bolt member having a threaded shank portion 64*a* and a head 64*b*. The threaded shank 64*a* is snugly inserted through a circular central opening 66*a* in the base 66 of spike member 62 as illustrated in FIG. 7. The bolt head 64*b* has a suitable screwdriver slot formed at its center, such as a Phillips head cross-slot 64*c*. The cleat or calk 60 may be mounted on a boot sole through threaded engagement of the bolt 64 with a cleat mounting anchor 30 in similar fashion to mounting of the cleat or calk 10. If desired, one or more gripping barbs may be formed from the base 66 intermediate the spike elements 68*a–c* similar to the barbs 34*a–c* to better retain the calk 60 in releasable mounted relation on the boot sole.

Figure 9:
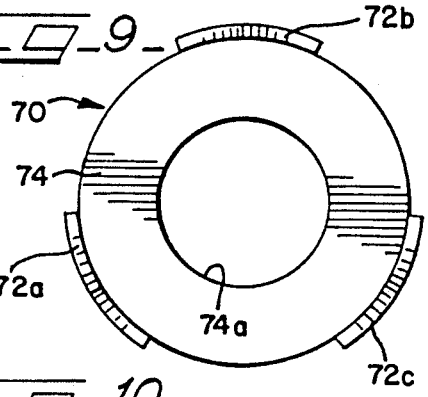
FIG. 9 is a bottom view of an alternative spike member which may be employed in the cleat or calk illustrated in FIG. 7.

FIG. 9 illustrates an alternative generally cup-shaped spike member 70 for use with the mounting bolt 64. The spike member 70 is similar to the spike member 62 except that its three triangular-shaped spike elements 72*a–c* are formed from a circular planar base 74 such that inwardly facing arcuate surfaces of the spike elements lie in a cylindrical envelope containing the circular peripheral edge of the base 74, whereas the spike elements 68*a–c* of the spike member 62 are formed such that their outwardly facing arcuate surfaces lie in a cylindrical envelope containing the circular peripheral edge of base 66. If desired, one or more gripping barbs may be formed from the base 70 intermediate the spike elements 72*a–c* similar to the barbs 34*a–c* to better retain the calk 70 in releasable mounted relation on the boot sole.

Figure 10:
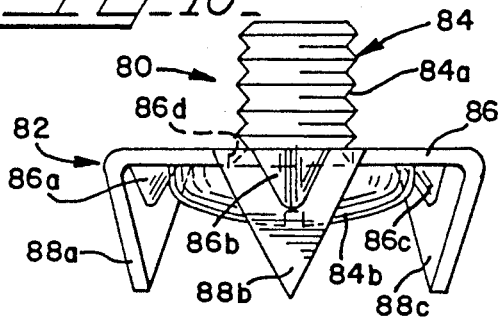
FIG. 10 is an elevational view of still another embodiment of a cleat or calk in accordance with the invention.
Figure 11:
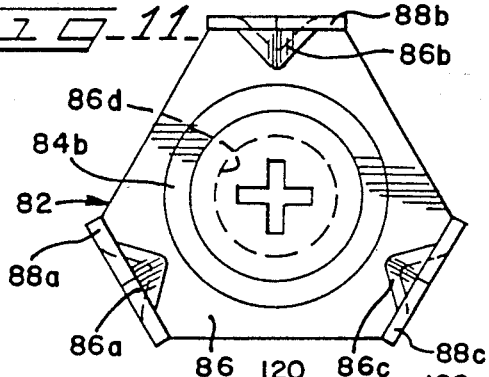
FIG. 11 is a bottom view of the cleat or calk illustrated in FIG. 10.

FIGS. 10 and 11 illustrate a further embodiment of a cleat or calk, indicated generally at 80, which includes a generally cup-shaped spike member 82 adapted to be affixed to a boot sole or the like through a mounting shank in the form of a separate and distinct mounting bolt 84 similar to mounting of the cleat or calk 60. The cup-shaped spike member 82 is similar to spike member 42 and includes a generally triangular-shaped planar base 86 from which downwardly depending triangular shaped spike elements 88*a–c* are formed along with integral reinforcing ribs or gussets 86*a–c*. The mounting bolt 86 has a threaded shank 84*a* adapted to be snugly inserted through a circular central opening 86*d* in the base 86, and has an enlarged head 84*b* enabling mounting of the cleat or calk 80 to a boot sole in fixed relation through a cleat anchor 30. If desired, barbs may be formed on the triangular spike elements 88*a–c* similar to the barbs 54*a–c* formed on the spike elements 46*a–c*.

Figure 12:
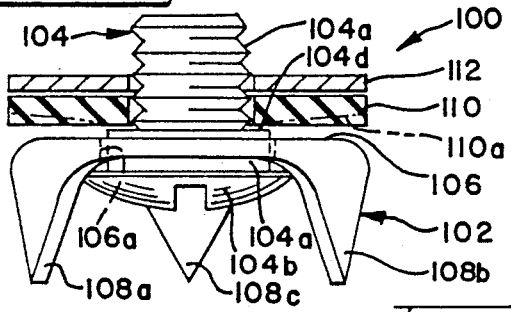
FIG. 12 is a combined side elevation and partial vertical sectional view of another embodiment of a cleat or calk in accordance with the present invention.
Figure 13:
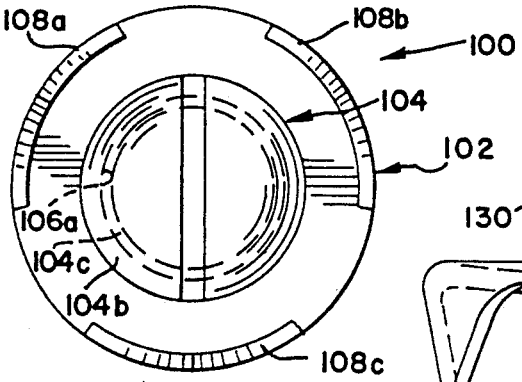
FIG. 13 is a bottom view of a cleat illustrated in FIG. 12.

FIGS. 12 and 13 illustrate another embodiment of a cleat or calk, indicated generally at 100, constructed in accordance with the present invention. A feature of the cleat or calk 100 is that when mounted on the sole of a boot, it is capable of pivoting to accommodate an uneven surface engaged by the cleat, and undergoes self-leveling when released from the underlying surface. The cleat or calk 100 includes a generally cup-shaped spike member 102 and a mounting shank 104 in the form of a discrete mounting bolt. The cup-shape spike member 102 is similar to spike member 62 and includes a generally planar circular base 106 having three downwardly depending equal angularly spaced triangular spike elements 108*a–c* which are formed integral with or otherwise suitably affixed along base edges to the base.

The mounting bolt 104 comprises a shoulder bolt having a threaded shank 104*a*, a head 104*b* and an intermediate cylindrical portion 104*c* of larger diameter than the threaded shank 104*a* so as to define an annular shoulder surface 104*d*. The base 106 has a central circular opening 106*a* of a diameter slightly greater than the diameter of the cylindrical portion 104*c* of bolt 104 so as to enable relative pivotal movement between the spike member 102 and the shoulder bolt.

Referring to FIG. 12, the cleat or calk 100 includes resilient spring means in the form of an annular resilient spring cushion 110 adapted to be interposed between the base 106 of the spike member 102 and the bottom surface 12*a* of a boot sole 12. The annular spring cushion 110 may take the form of a suitable resilient rubber washer-like member or a metallic spring such as a coil spring, a wave washer, or one or more Bellville type springs selectively stacked on the threaded shank 104*a*. Preferably, an annular metallic washer 112 is employed to directly abut the boot sole surface, with the resilient spring cushion 110 sandwiched between the washer and the base 106 of spike member 102. If desired, one or both of the annular side surfaces of the spring cushion 110 may be formed as frusto-conical surfaces such as indicated in phantom at 110*a* in FIG. 12.

When secured to an anchor 30 on a boot sole or the like, the cleat or calk 100 is firmly engaged against the annular spring cushion 110. The spring cushion 110 is sufficiently resilient to enable limited pivotal movement of the spike member relative to the should bolt 104 when the spike elements 108*a–c* engage an uneven or irregular surface, such as a rock or log, and effect self-leveling of the spike member to its normal position with the spike elements generally parallel to the longitudinal axis of the shoulder screw 104 when the spike member is released from the uneven surface or object which caused such rocking or pivotal movement.

Figure 14:
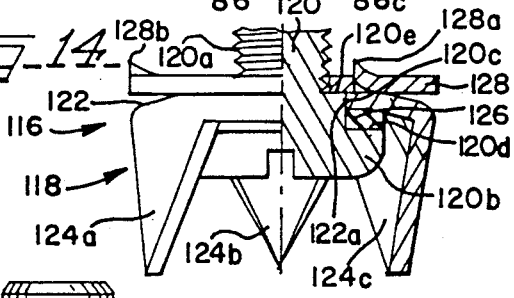
FIG. 14 is a fragmentary combined elevational and vertical sectional view of another embodiment of a cleat or calk in accordance with the invention.

FIG. 14 illustrates another embodiment of a cleat or calk, indicated generally at 116, which is generally similar to the cleat or calk 100 in that calk 116 is capable of pivoting to accommodate an uneven surface engaged by the calk when mounted on the sole of a boot, and undergoes self-leveling when released from the underlying surface. The cleat or calk 116 includes a generally cup-shaped spike member 118 and a mounting shank 120 in the form of a discrete mounting bolt. The cup-shape spike member 118 is similar to spike member 102 except that spike member 118 includes a generally dish-shaped circular base 122 having three downwardly depending equal angularly spaced triangular spike elements 124*a–c* which are formed integral with or otherwise suitably affixed along base edges to the base 122.

The mounting bolt 120 comprises a shoulder bolt having a threaded shank 120*a*, a head 120*b* and an intermediate cylindrical portion 120*c* of larger diameter than the threaded shank 120*a* so as to define a pair of annular shoulder surfaces 120*d* and 120*e*. The base 122 has a central circular opening 122*a* of a diameter slightly greater than the diameter of the cylindrical portion 120*c* of bolt 120 so as to enable relative pivotal movement between the spike member 118 and the shoulder bolt.

The cleat or calk 116 differs from calk 100 in that it includes self-leveling resilient spring means in the form of an annular resilient spring cushion 126 adapted to be interposed between the base 122 of the spike member 118 and the annular surface 120*d* of shoulder bolt 120. The annular spring cushion 126 may also take the form of a suitable resilient rubber washer-like member or a metallic spring such as a coil spring, a wave washer, or one or more Bellville type springs selectively stacked on the shoulder surface 120*d*. Preferably, an annular metallic washer 128 is employed to directly abut the boot sole surface and provide a bearing surface engaged by the dish-shaped base 122 of the self-leveling spiked cup member 118, with the resilient spring cushion 126 sandwiched between the head of the shoulder bolt and the base 122 of spike member 118. If desired, one or both of the annular side surfaces of the spring cushion 126 may be formed as frusto-conical surfaces such as indicated in phantom at 110*a*in FIG. 12. The washer 128 preferably has gripping barbs, such as indicated at 128*a,b*, to releasably affix the washer to the boot sole.

When secured to an anchor 30 on a boot sole or the like, the spike member 118 firmly engages the annular washer 128 in metal-to-metal relation. Instead of a weighted boot flexing on the spring cushion 126, the weight is transmitted directly to the spike member 118 through washer 128. However, the spring cushion 126 is sufficiently resilient to enable limited pivotal flexing movement of the spike member relative to the should bolt 120 when the spike elements 124*a–c* engage an uneven or irregular surface, such as a rock or log, and effect self-leveling of the spike member to its normal position with the spike elements generally parallel to the longitudinal axis of the shoulder screw when the spike member is released from the uneven surface or object which caused such rocking or pivotal movement.

By mounting the spring cushion 126 between the head of shoulder bolt 120 and the base 122 of spike member 118, a number of advantages are achieved. For example: abrasives trapped on and around the spring cushion will not wear it out as rapidly as might result from directly weighting the cushion; positive contact is made between the spike member and the bearing washer 128; the spring cushion is sheltered by the cup-shaped spike member and the mounting bolt head; and the spring cushion both normally maintains the cup against the bearing washer and enables continued cushioning when the spike member flexes or pivots off its normal neutral position without being severely pinched by the weight of boot wearer.

Figure 15:
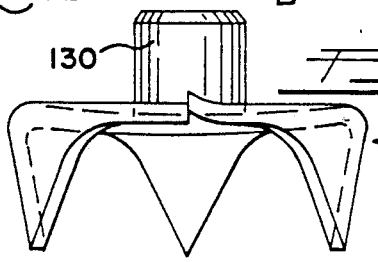
FIG. 15 is a side elevational view of another alternative embodiment of a cleat or calk in accordance with the invention.

While the various embodiments of the cleats or calks in accordance with the invention have been described as being adapted for threaded attachment to a cleat anchor or receptacle secured within a boot sole or the like, it will be understood that the various cleats or calks may be mounted on a boot sole by alternative attachment techniques. For example, the threaded shanks may alternatively take the form of suitable cylindrical shanks sized to provide a fixed interference fit within a generally cylindrical non-threaded barrel portion 30*a* of a cleat or calk anchor 30. FIG. 15 illustrates a cylindrical nonthreaded shank 130 formed on a cleat or calk 132 which is otherwise generally similar to the calk or cleat 10 illustrated in FIGS. 1–3.

Also, while the various embodiments of the cleats or calks in accordance with the invention have been described as employing spike members formed with three spike elements, spike members having a number of spike elements greater than three may be desirable for some applications. However, it is believed that for uneven terrain or other non-flat surfaces, calks having three spike elements disposed at 120° angularly spaced relation about the central axis of the corresponding spike member provide a desirable tripod contact effect and efficient flexing of the spike member.

Thus, in accordance with the invention, various embodiments of a cleat or calk are provided which are adapted for mounting on a boot sole or the like and each of which provides a plurality of ground engaging spike elements for each corresponding cleat anchor in the boot sole. In the illustrated embodiments, each spike member has three equal angularly spaced triangular spike elements formed about the center axis of a base such that the spike elements extend in normal relation from the base and enable mounting on the boot sole through mounting shanks. By providing a plurality of spike elements on each cleat or calk, a substantially greater number of spike elements may be provided per unit area of boot sole for a given number of cleat or calk anchors 30 than obtained with prior singular conical shaped spike elements. The greater number of spike elements provides improved safety while also providing significantly greater wear life. Conversely, significantly fewer cleats or calks of the present invention are required in comparison to prior spike-type cleats or calks on a boot sole to provide comparable gripping characteristics. By providing spring or resilient cushioned mounting of the spike members or pivotal spike members spring damped in accordance with the invention, the spike elements may undergo pivotal movement and accommodate uneven surfaces, thereby improving safety while effecting self-leveling after release of the spike elements from the uneven surface.

While preferred embodiments of the invention have been illustrated and described, it will be understood that changes and modifications may be made therein without departing from the invention in its broader aspects. Various features of the invention are defined in the following claims

What is claimed is:

1. A cleat or calk comprising a generally cup-shaped spike member having a base and a plurality of spike elements affixed to said base and extending from one side thereof in generally normal relation to said base, mounting shank means cooperative with said base in a manner to enable mounting of the cleat or calk on a mounting surface, and resilient means cooperative with said mounting shank means and said spike member, said resilient means being operative to enable resilient mounting of the spike member on the mounting surface and being operative to effect self-leveling of the spike member when released from an uneven underlying surface.

2. A cleat or calk as defined in claim 1 wherein said mounting shank means comprises a shoulder bolt, said base having a central opening therethrough of a diameter sufficient to enable relative pivotal movement between the spike member and said shoulder bolt when inserted through said central opening, said resilient means comprising spring means mounted on said shoulder bolt so as to be interposed between said spike member and the mounting surface when the cleat or calk is mounted thereon.

3. A cleat or calk as defined in claim 2 including a washer mounted on said shoulder bolt so as to engage the surface of the mounting surface with said spring means interposed between said washer and said spike member.

4. A cleat or calk as defined in claim 1 wherein said resilient means comprises an annular resilient spring cushion adapted to enable dampened flexing and self-leveling of said spike member relative to said mounting shank means.

5. A cleat or calk as defined in claim 1 wherein said mounting shank means comprises a shoulder bolt having a head portion, said base being adapted to receive said shoulder bolt therethrough so as to enable relative pivotal movement between said spike member and said shoulder bolt, said resilient means being mounted between the head of said shoulder bolt and said base of said spike member so as to normally bias the base of said spike member against the mounting surface, said resilient means enabling pivotal movement of said spike member when said spike elements engage an uneven surface during use.

6. A cleat or calk as defined in claim 5 wherein said resilient means comprises a resilient annular spring.

7. A cleat or calk as defined in claim 5 including an annular washer mounted coaxially on said shoulder bolt so as to engage the base of said spike member and define a bearing surface for said base when the calk is mounted on a mounting surface.

8. A cleat or calk as defined in claim 1 wherein said spike member is made from a metallic sheet material, said spike elements being formed integral with said base and drawn into normal relation to said base.

9. A cleat or calk as defined in claim 8 wherein said cup-shaped spike member is made from a material selected from a group comprising non-corrosive stainless steel, hardened steel, anodized aluminum, plastic, and a composite material.

10. A cleat or calk assembly for mounting on a boot sole or the like to enhance gripping of the sole with an underlying surface, said cleat or calk comprising, in combination, a generally cup-shaped spike member including a base having an opening at its center axis and a plurality of pointed spike elements extending from a common side of said base in spaced generally parallel relation to said center axis, a shoulder bolt extending through said central opening in said base and adapted for mounting relation with a cleat anchor fixed to the boot sole, and spring means mounted on said shoulder bolt and cooperative with said spike member so as to enable pivotal flexing and self-leveling of said spike member relative to said shoulder bolt.

11. A cleat or calk as defined in claim 10 wherein said mounting shank comprises an externally threaded shank member adapted for threaded cooperation with a cleat anchor affixed to the boot sole.

12. A cleat or calk as defined in claim 10 wherein said spring means comprises a spring cushion member, and said base has a convex surface engaged by said spring cushion member.

13. A cleat or calk as defined in claim 10 wherein said spring means comprises a spring cushion member selected from a group comprising an annular resilient rubber washer-like member, a coil spring, a wave washer, and one or more Bellville type springs.

14. A cleat or calk as defined in claim 12 wherein said spring cushion member comprises an annular resilient member having a frusto-conical surface facing said convex base surface so as to normally define an annular wedge-shaped space between said cushion member and said spike member when mounted on a boot sole or the like.

15. In a boot for use on rough terrain and the like which includes a sole having an inner surface and an outer exposed surface and being capable of flexure; the combination therewith comprising at a plurality of calk-mounting receptacles each having a tubular sleeve extending through an opening in the sole, a corresponding number of cup-shaped calks each having a substantially planar base and three spike elements fixed to the base and extending from one side thereof in generally normal relation to said base, said spike elements being substantially equidistantly spaced about a center axis of said base and being of generally equal triangular configuration so as to define pointed ends lying in a common plane substantially parallel to said base, and mounting shank means cooperative with the center of each calk base and mountable in a corresponding sleeve to secure said base against the outer surface of said sole with said spike elements extending outwardly in generally normal relation to the sole, said spike elements and the flexure of said sole being cooperative to provide a tripod contact effect wherein each calk undergoes self-leveling by distributing contact forces substantially equally between its spike elements.

16. A boot as defined in claim 15 wherein said base is substantially circular.

17. A boot as defined in claim 15 wherein said base has a generally triangular configuration and has said three spike elements affixed thereto at the corners of said triangular base.

18. A boot as defined in claim 17 including reinforcing ribs interposed between each of said painted spike elements and said base.

19. A boot as defined n claim 15 wherein said spike elements are formed integral with said base.

20. A boot as defined in claim 15 wherein said mounting shank means extends generally normal to said base and is coaxial with a center axis of said base.

21. A boot as defined in claim 20 wherein said mounting shank means includes an externally threaded shank adapted for threaded cooperation with said internally threaded sleeve.

22. A boot as defined in claim 21 wherein said spike members include barb means adapted for engagement with the boot sole so as to prevent inadvertent release from said calk-mounting receptacle.

23. A boot as defined in claim 15 wherein said base has a central opening therethrough, said mounting shank means including a threaded bolt adapted to be inserted through said opening and being cooperative with the sleeve to facilitate releasable mounting of the calk on the boot sole.

24. A boot as defined in claim 15 wherein each of said triangular shaped spike elements includes a barb cooperative with the boot sole to prevent inadvertent rotational release of the calk from the calk-mounting receptacle.

25. A boot as defined in claim 15 wherein said base has an opening formed at its center axis, said mounting shank means comprising a bolt adapted to extend through said opening and having a head adapted to retain the calk against the boot sole when the bolt is mounted in the sleeve.

26. A boot as defined in claim 15 wherein said base has at least one barb displaced from the base so as to embed itself in the sole and prevent inadvertent release of the calk from the calk-mounting receptacle.

27. A boot as defined in claim 15 wherein said annular flange has at least one anchor element formed thereon which is pressed into the sole to prevent rotation of the calk-mounting receptacle relative to the sole.

28. A boot as defined in claim 15 wherein each of said calk-mounting receptacles has an annular flange fixed coaxially to an inner end of its sleeve for engagement with the inner surface of the sole peripherally of the sleeve, said planar calk bases being cooperative with the corresponding annular flanges to clamp the sole between said bases and flanges.

* * * * *

UNITED STATES PATENT AND TRADEMARK OFFICE

CERTIFICATE OF CORRECTION

PATENT NO. : 5,029,405

DATED : July 9, 1991

INVENTOR(S) : Lon DeHaitre

It is certified that error appears in the above-identified patent and that said Letters Patent is hereby corrected as shown below:

Line 10 of the Abstract, "acommodate" should be --accommodate--.

Column 3, line 35, after the coma (,) insert --which in the illustrated embodiment comprise three spike elements--.

Column 3, line 65, delete "25".

In the claims:

Column 10, line 67, "painted" should be --pointed--.

Column 11, line 6, after "20" insert --wherein said tubular sleeve has an internal thread, and--.

Signed and Sealed this

First Day of December, 1992

*Attest:*

DOUGLAS B. COMER

*Attesting Officer*

*Acting Commissioner of Patents and Trademarks*